US011326827B2

(12) United States Patent
Heo et al.

(10) Patent No.: US 11,326,827 B2
(45) Date of Patent: May 10, 2022

(54) REFRIGERATOR

(71) Applicant: SAMSUNG ELECTRONICS CO., LTD., Suwon-si (KR)

(72) Inventors: Kwang Su Heo, Yongin-si (KR); Young-Bae Hong, Gwangju (KR); Ki-Hyun Kim, Suwon-si (KR); Jong-hoon Oh, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 471 days.

(21) Appl. No.: 16/341,300

(22) PCT Filed: Sep. 25, 2017

(86) PCT No.: PCT/KR2017/010540
§ 371 (c)(1),
(2) Date: Apr. 11, 2019

(87) PCT Pub. No.: WO2018/070692
PCT Pub. Date: Apr. 19, 2018

(65) Prior Publication Data

US 2021/0285714 A1 Sep. 16, 2021

(30) Foreign Application Priority Data

Oct. 11, 2016 (KR) ..... 10-2016-0131152

(51) Int. Cl.
*F25D 17/08* (2006.01)
*F25D 17/06* (2006.01)
*F25D 23/06* (2006.01)

(52) U.S. Cl.
CPC ..... *F25D 17/08* (2013.01); *F25D 17/062* (2013.01); *F25D 17/067* (2013.01);
(Continued)

(58) Field of Classification Search
CPC ..... F25D 17/08; F25D 17/062; F25D 17/067; F25D 23/069; F25D 23/068;
(Continued)

(56) References Cited

U.S. PATENT DOCUMENTS 3,473,345 A 10/1969 Pfeiffer et al.
3,590,594 A 7/1971 Arend
(Continued)

FOREIGN PATENT DOCUMENTS

CN 1648562 8/2005
CN 102575892 A 7/2012
(Continued)

OTHER PUBLICATIONS

Chinese Office Action dated Sep. 1, 2020 in Chinese Patent Application No. 201780062974.4.
(Continued)

*Primary Examiner* — David J Teitelbaum
(74) *Attorney, Agent, or Firm* — Staas & Halsey LLP

(57) ABSTRACT

A refrigerator having a cool air circulation unit for directly supplying heat-exchanged cool air to a storage compartment is disclosed. The cool air circulation unit supplies and discharges the cool air, which has been heat-exchanged in an evaporator, to and from the storage compartment through a flow passage provided inside a partition.

15 Claims, 16 Drawing Sheets

(52) U.S. Cl.
CPC ..... *F25D 23/068* (2013.01); *F25D 23/069* (2013.01); *F25D 2201/126* (2013.01); *F25D 2317/0653* (2013.01); *F25D 2317/0663* (2013.01); *F25D 2317/0671* (2013.01); *F25D 2317/0672* (2013.01)

(58) Field of Classification Search
CPC ..... F25D 2317/0653; F25D 2317/0671; F25D 2201/126; F25D 2317/0672; F25D 2317/0663; F25D 2317/067; F25D 2400/04; F25D 2323/06; F25D 23/06; F25D 23/062; F25D 2325/021
USPC ..... 29/890.035
See application file for complete search history.

(56) References Cited

U.S. PATENT DOCUMENTS

| | | | | |
|---|---|---|---|---|
| 4,539,819 | A | 9/1985 | Alba et al. | |
| 5,737,935 | A * | 4/1998 | Heo | F24F 11/30 62/186 |
| 6,568,773 | B1 * | 5/2003 | Park | F25D 17/08 312/406.1 |
| 2004/0107724 | A1 * | 6/2004 | Kim | F25D 17/045 62/408 |
| 2008/0134708 | A1 * | 6/2008 | Lee | F25C 5/22 62/340 |
| 2009/0113924 | A1 | 5/2009 | Bae et al. | |
| 2012/0011879 | A1 * | 1/2012 | Gu | F25D 17/04 62/408 |

FOREIGN PATENT DOCUMENTS

| | | |
|---|---|---|
| CN | 105696290 | 6/2016 |
| EP | 3026168 | 6/2016 |
| JP | 2010-94206 | 4/2010 |
| KR | 10-0196945 | 6/1999 |
| KR | 10-0382480 | 5/2003 |
| KR | 10-0464201 | 1/2005 |
| KR | 10-2005-0077555 | 8/2005 |
| KR | 10-2016-0052507 | 5/2016 |

OTHER PUBLICATIONS

International Search Report dated Jan. 16, 2018 in corresponding International Application No. PCT/KR2017/010540.
Written Opinion of the International Searching Authority dated Jan. 16, 2018 in corresponding International Application No. PCT/KR2017/010540.
Chinese Office Action dated Oct. 9, 2019 in Chinese Patent Application No. 201711403684.X.
European Office Action dated Aug. 28, 2019 in European Patent Application No. 17203523.0.
Extended European Search Report dated Aug. 26, 2019 in European Patent Application No. 17859517.9.
Indian Office Action dated May 19, 2021 in Indian Patent Application No. 201917017984.
Chinese Office Action dated Mar. 29, 2021 in Chinese Patent Application No. 201780062974.4.
Chinese Office Action for Chinese Patent Application No. 201780062974.4 dated Jul. 21, 2021.
Chinese Office Action dated Jan. 24, 2022 in Chinese Application No. 201780062974.4 (6 pages; 8 pages English translation).

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2017/010540 filed on Sep. 25, 2017, which claims foreign priority benefit under 35 U.S.C. § 119 of Korean Patent Application No. 10-2016-0131152 filed Oct. 11, 2016, the entire contents of both of which are incorporated herein by reference.

TECHNICAL FIELD

The following embodiments relate to a refrigerator. Specifically, the following embodiments relate to a refrigerator having a cool air circulation unit including flow passages for guiding cooled air directly to a storage compartment.

BACKGROUND ART

A refrigerator includes rotating doors for opening and closing a plurality of storage compartments (for example, a refrigerating compartment, a freezing compartment and/or an intermediate compartment).

Cool air supplied to a storage compartment of the refrigerator is heat-exchanged in an evaporator and supplied from the outside (for example, the outside of an inner case) of the storage compartment to the storage compartment. A separate duct (or a cable-shaped supply duct) for supplying cool air and a separate duct (or a cable-shaped discharge duct) for discharging cool air may be applied.

In a case where the separate supply duct and/or the discharge duct and the inner case are to be combined, additional tapes or seals are needed to prevent the loss of the cool air.

DISCLOSURE OF INVENTION

Technical Solution

In accordance with an aspect of the present disclosure, a refrigerator includes an evaporator, a main body including an inner case, an outer case and an insulator foamed between the inner case and the outer case, and a cool air circulation unit having an inner flow passage to supply cool air heat-exchanged in the evaporator to a storage compartment of the inner case, wherein the inner flow passage in the cool air circulation unit is positioned inside and outside the inner case.

According to an aspect of the present disclosure, the cool air circulation unit may include an intermediate partition duct positioned outside the inner case, an intermediate partition positioned below the intermediate partition duct and inside the inner case, and an evaporator cover connected to the intermediate partition below the intermediate partition and positioned inside the inner case.

According to an aspect of the present disclosure, the intermediate partition duct may include an inflow passage to receive the cool air from the evaporator cover, a chamber connected to the inflow passage and receiving the cool air, and an outflow passage connected to the chamber and supplying the cool air to the storage compartment.

According to an aspect of the present disclosure, the intermediate partition duct may further include a chamber cover to cover the chamber, and the chamber may change the traveling direction of the cool air, which has been supplied from the inflow passage, to the outflow passage.

According to an aspect of the present disclosure, the traveling direction of the cool air may be changed by at least one of the chamber, the chamber cover, and the outflow passage.

According to an aspect of the present disclosure, the cool air may start to flow from the inner case along the inner flow passage of the cool air circulation unit, flow outside the inner case, and be finally supplied to the storage chamber of the inner case.

According to an aspect of the present disclosure, the inflow passage and the outflow passage provided inside the intermediate partition duct may be positioned outside the inner case.

According to an aspect of the present disclosure, a first return flow passage to discharge the cool air in the storage compartment may be provided inside the intermediate partition.

According to an aspect of the present disclosure, an inlet of the first return flow passage may be positioned on the surface of the intermediate partition facing the intermediate partition duct.

According to an aspect of the present disclosure, the evaporator cover may include a second return flow passage therein to discharge the cool air discharged from the first return flow passage of the intermediate partition to the evaporator.

According to an aspect of the present disclosure, the evaporator cover may further include a fan, and the cool air may circulate through the inner flow passage of the cool air circulation unit by the fan.

In accordance with another aspect of the present disclosure, a refrigerator includes a main body including an evaporator, an inner case to accommodate the evaporator at a lower end thereof, an outer case and an insulator foamed between the inner case and the outer case, and a cool air circulation unit including an intermediate partition duct, an intermediate partition positioned below the intermediate partition duct and an evaporator cover positioned below the intermediate partition, wherein the cool air, which has been heat-exchanged in the evaporator, circulates through a first flow passage provided inside the intermediate partition duct, a second flow passage provided inside the intermediate partition, and a third flow passage provided inside the evaporator cover.

According to an aspect of the present disclosure, one side of the intermediate partition duct may be in contact with the inner case from the outside of the inner case, and one side of the intermediate partition may be in contact with an inner side of the inner case.

Advantageous Effects

A cool air circulation unit to directly supply heat-exchanged cool air to a storage compartment without additional components can be provided.

A refrigerator having a cool air circulation unit to directly supply heat-exchanged cool air to a storage compartment without additional components can be provided.

A refrigerator having a cool air circulation unit to directly supply heat-exchanged cool air to a storage compartment without additional components and to discharge the cool air from the storage compartment can be provided.

Without being limited thereto, according to various embodiments of the present disclosure, a refrigerator having a cool air circulation unit to directly supply cool air heat-exchanged in an evaporator to a storage compartment and to circulate the cool air from the storage compartment to the evaporator can be provided.

MODE FOR INVENTION

Hereinafter, exemplary embodiments according to the present disclosure will be described in detail with reference to the accompanying drawings. Like reference numbers or marks in the respective drawings indicate parts or components that perform substantially the same function.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and has are intended to indicate that there are features, numbers, steps, operations, elements, parts, or combinations thereof described in the specification, and do not exclude the presence or addition of one or more other features, numbers, steps, operations, elements, parts, or combinations thereof.

Figure 1:
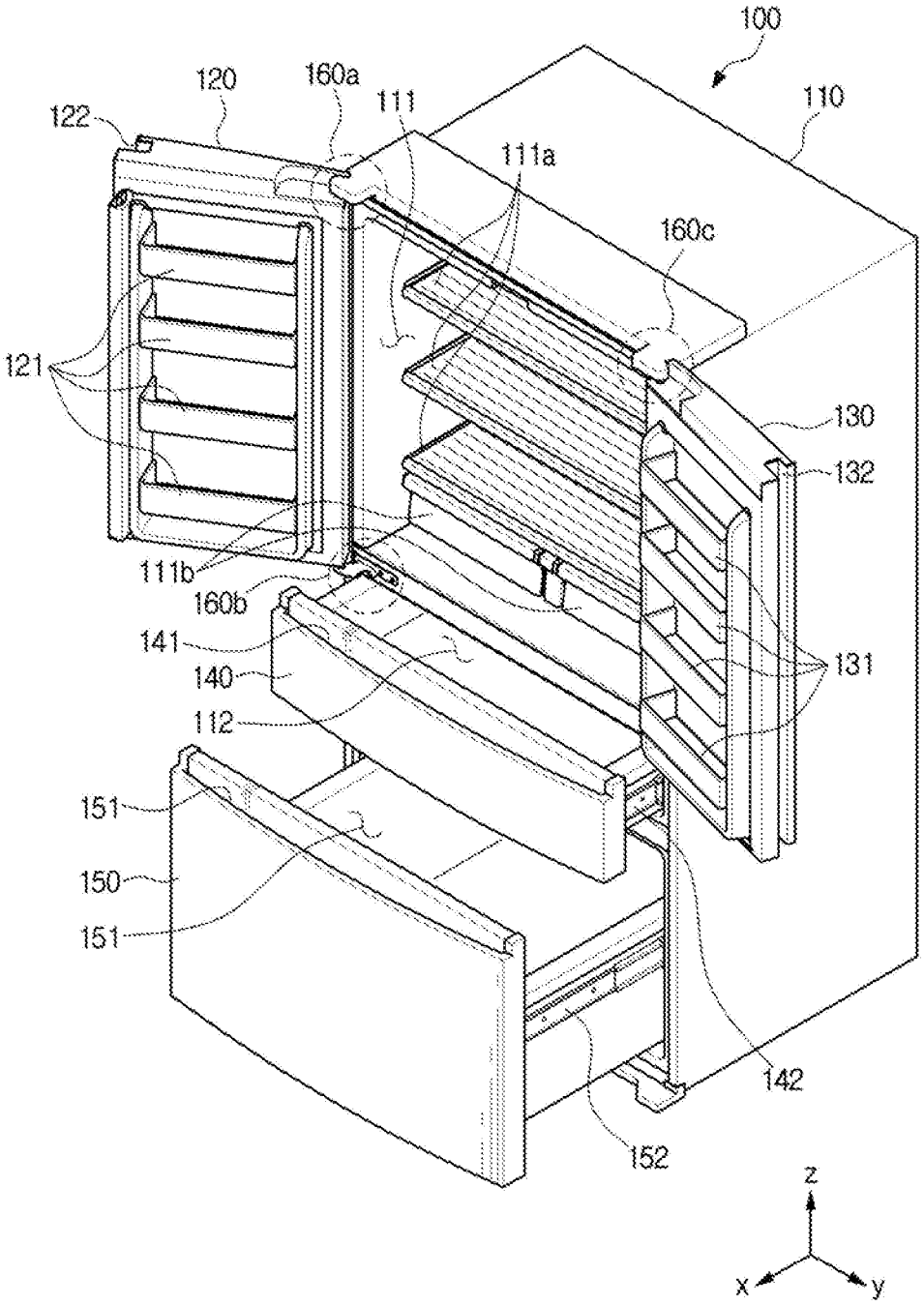
FIG. 1 is a schematic perspective view of a refrigerator according to an embodiment of the present disclosure.

FIG. 1 is a schematic perspective view of a refrigerator according to an embodiment of the present disclosure.

Figure 2:
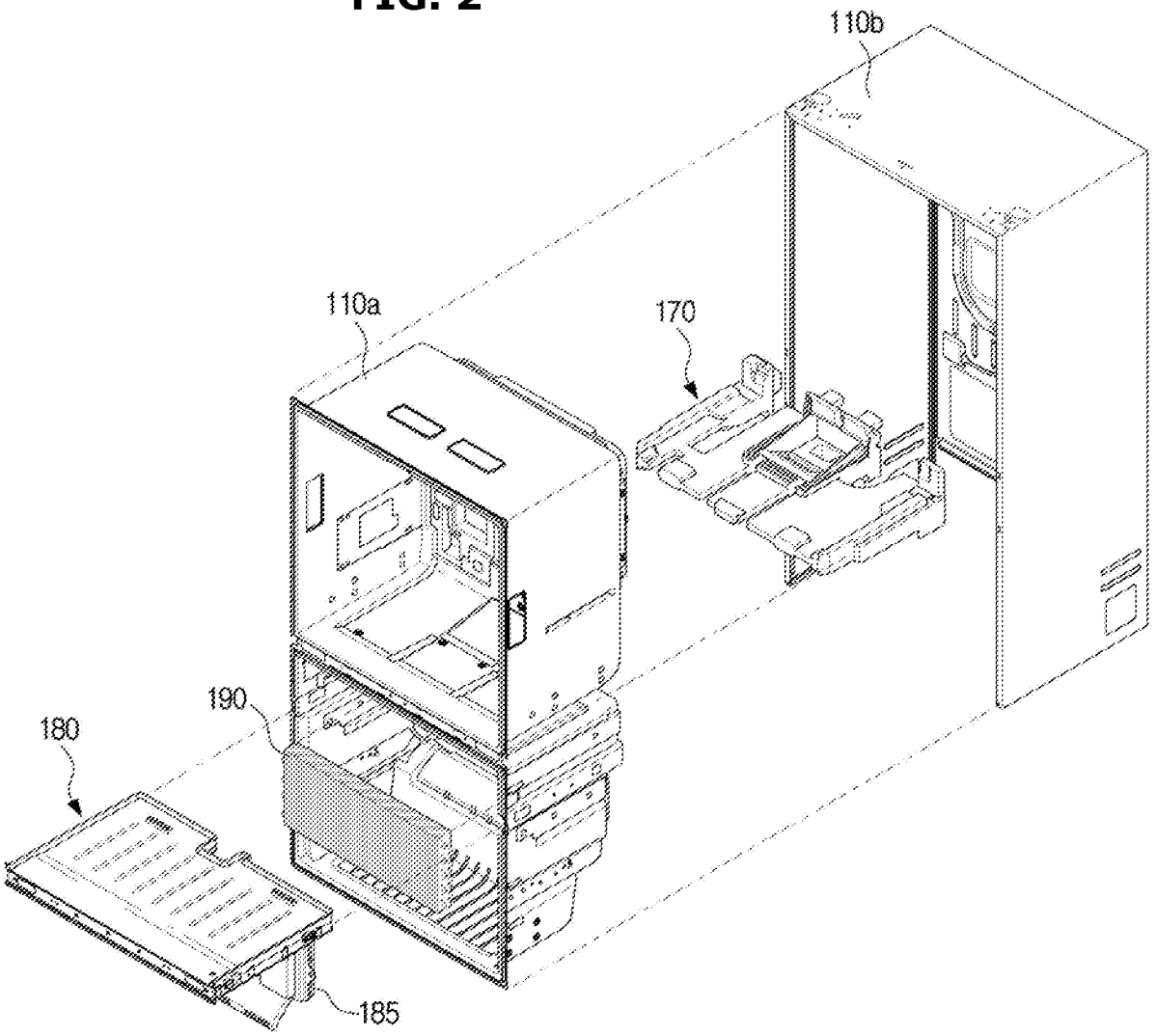
FIG. 2 is a schematic exploded perspective view of a refrigerator according to an embodiment of the present disclosure.

FIG. 2 is a schematic exploded perspective view of a refrigerator according to an embodiment of the present disclosure.

Figure 3A:
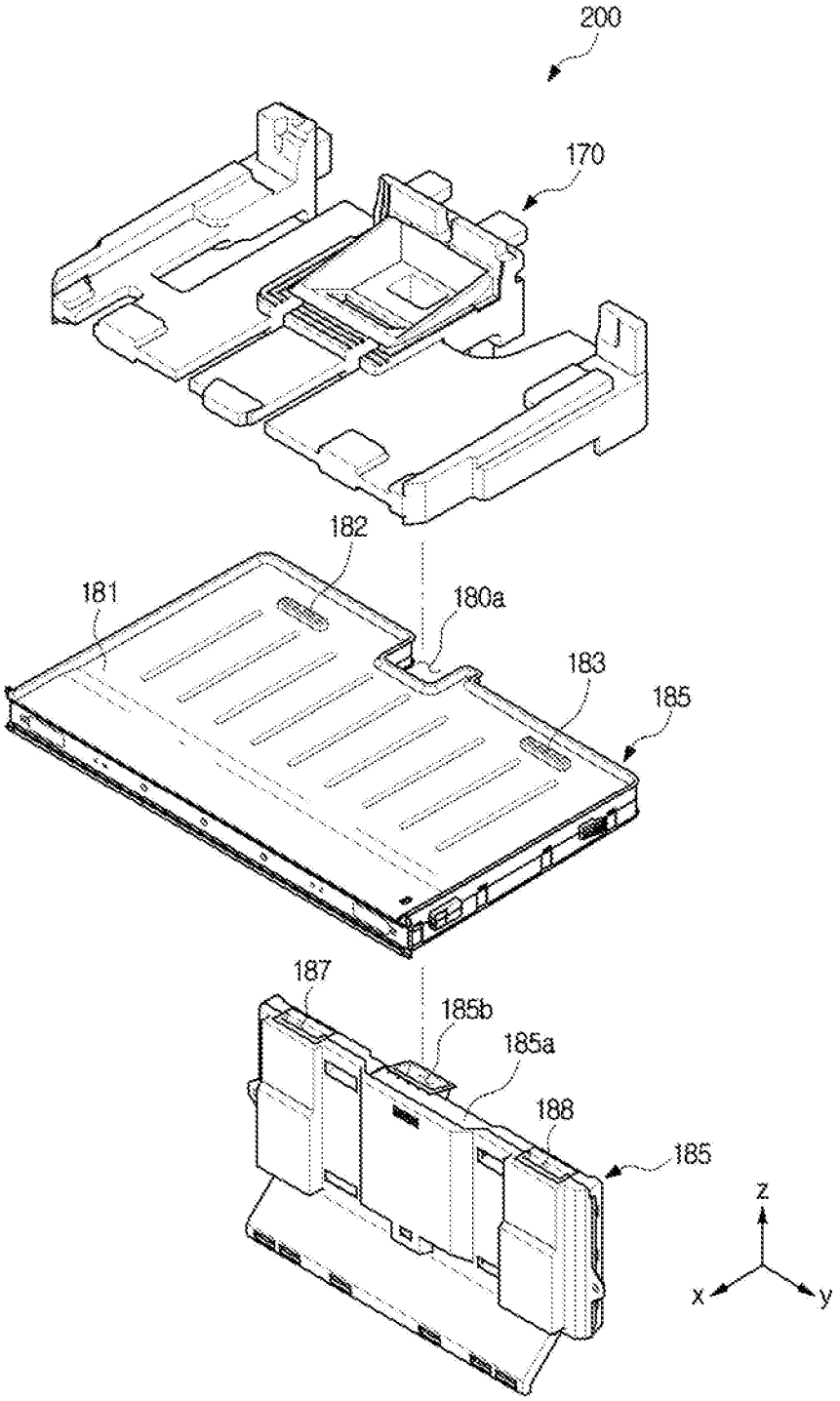
FIGS. 3*a* and 3*b* are a schematic perspective view and a schematic cross-sectional view of a cool air circulation unit of a refrigerator according to an embodiment of the present disclosure.
Figure 3B:
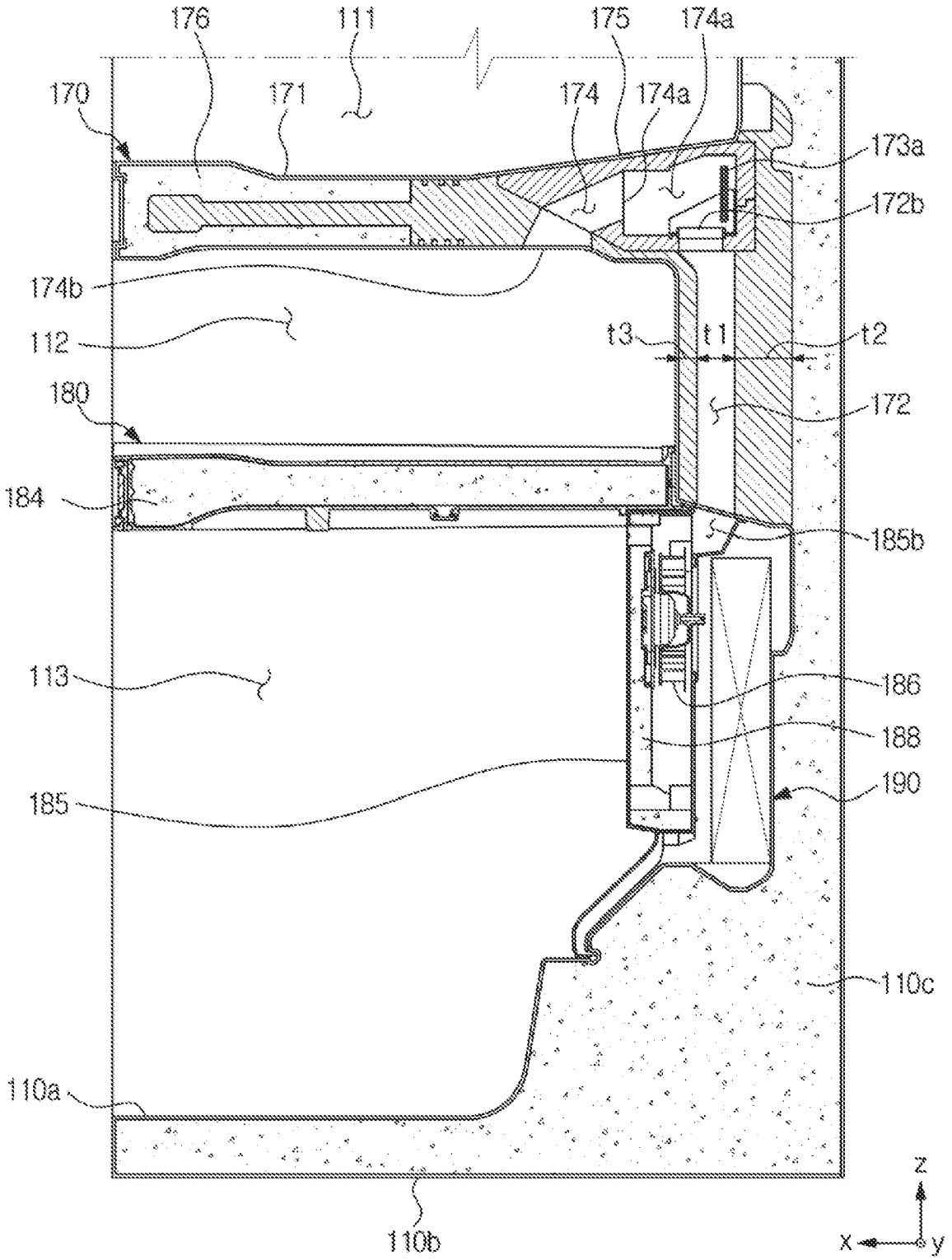

FIGS. 3*a* and 3*b* are a schematic perspective view and a schematic cross-sectional view of a cool air circulation unit of a refrigerator according to an embodiment of the present disclosure.

Referring to FIG. 1 to FIGS. 3*a* and 3*b*, a refrigerator 100 includes a main body 110, first and second doors 120 and 130, drawers 140 and 150, and hinges 160*a* to 160*f*.

The main body 110 includes storage compartments 111 to 113 that are formed inside the main body 110 and opened and closed by the first and second doors 120 and 130 to store water, beverages, and refrigerated or frozen foods. The storage compartments 111 to 113 may also store food materials.

The main body 110 further includes an inner case 110*a* forming the storage compartments 111 to 113, an outer case 110*b* forming an outer appearance of the refrigerator 100, and an insulator 110*c* foamed between the inner case 110*a* and the outer case 110*b*. The insulator 110*c* may prevent the outflow of cool air from the inside of the storage compartments 111 to 113 to the outside and may prevent the inflow of outside air into the storage compartments 111 to 113.

The main body 110 further includes a cool air supply unit (not shown) that is provided at a lower end thereof to supply cool air heat-exchanged through a refrigeration cycle to the storage compartments 111 to 113. The cool air supply unit may include a compressor (not shown) for compressing a refrigerant, a condenser (not shown), an expansion valve (not shown), an evaporator 190, and pipes (not shown). The heat-exchanged cool air may be supplied (or circulated) to the storage compartments 111 to 113 through flow passages 185*b* and 172. The main body 110 may include a plurality of evaporators. For example. The main body 110 may include a first evaporator (not shown) for supplying cool air to the storage compartment 111 and the second evaporator 190 for supplying cool air to the storage compartments 112 and 113. The cool air that has been heat-exchanged in the plurality of evaporators may be supplied (or circulated) to each of the storage compartments 111 to 113 through the flow passages 185*b* and 172.

The storage compartments 111 to 113 may be divided by an intermediate partition duct 170 and a partition 180. The storage compartments 111 to 113 may be divided into the freezing storage compartments 112 and 113 (hereinafter, they may be referred to as "freezing compartment") and the refrigerating storage compartment 111 (hereinafter, it may be referred to as "refrigerating compartment") positioned above the freezing compartments 112 and 113. The freezing compartments 112 and 113 may include the first freezing compartment 112 and the second freezing compartment 113.

The intermediate partition duct 170 may be positioned between the refrigerating compartment 111 and the first freezing compartment 112. The partition or intermediate partition 180 may be positioned between the first freezing compartment 112 and the second freezing compartment 113. An evaporator cover 185 coupled with the intermediate partition 180 may be positioned between the second freezing compartment 113 and the evaporator 190. The intermediate partition duct 170, the intermediate partition 180 and the evaporator cover 185 will be described later.

The storage compartment 112 may be set to a temperature above zero (for example, between 7° C. and 0° C., which may be changed by setting) or a temperature below zero (for example, between −1° C. and −5° C., which may be changed by setting) to store water, beverage, food materials, and refrigerated or frozen foods. The water or beverage may be contained in a beverage container.

The storage compartment 113 may be set to a temperature below zero (for example, between −10° C. and −18° C., which may be changed by setting) to store food materials or frozen foods that need to be stored for a long period of time.

The refrigerating compartment 111 may include one or a plurality of shelves 111*a* and one or a plurality of storage boxes 111*b*.

The first door 120 may be coupled to one side (for example, the left side) of the refrigerating compartment 111, and the second door 130 adjacent to the first door 120 may be coupled to the other side (for example, the right side) of the refrigerating compartment 111. The first door 120 and the second door 130 may be rotated at a predetermined angle (for example, 300° or less) by the hinges 160*a* to 160*f* to open and close (for example, coupled to or separated from) a front surface of the refrigerating compartment 111.

The first door 120 may be rotated (for example, clockwise) as opposed to the rotational direction (for example, counterclockwise) of the second door 130. The first door 120 may also be rotated in the same direction as the second door 130.

The position of the first door 120 and the second door 130 may be changed. For example, the first door 120 may be positioned on the right side of the refrigerating compartment 111, and the second door 130 may be positioned on the left side of the refrigerating compartment 111.

The first door 120 may include at least one of an operation panel (not shown) that displays the functions and settings of the refrigerator 100 on the surface of the operation panel and may be changed by input by a user (for example, touch or selection of a button) and a dispenser (not shown) for providing water, ice or sparkling water. The first door 120 may include a handle 122 that may be gripped.

One or a plurality of door guards 121 capable of accommodating beverage containers or food may be provided inside the first door 120.

The second door 130 may include a handle 132 that may be gripped. The handle 122 of the first door 120 and the handle 132 of the second door 130 may be disposed to be spaced apart from each other with respect to a central region of the refrigerating compartment 111. One or a plurality of door guards 131 capable of accommodating beverage containers or food may be provided inside the second door 130.

The drawers 140 and 150 are positioned below the first and second doors 120 and 130. The drawers 140 and 150 may be drawn out in a first direction (for example, x-axis direction) through rails 142 and 152 (for example, by sliding or rolling). The drawers 140 and 150 may have handles 141 and 151, respectively.

The drawers 140 and 150 according to another embodiment of the present disclosure may be changed into a plurality of doors (not shown). The storage compartments 112 and 113 may be combined into one storage compartment (not shown), for example, as in the case of the refrigerating compartment 111. The one storage room (not shown) may have a door (not shown) on the left and right sides, respectively, as in the case of the refrigerating compartment 111. The refrigerator 100 may have a plurality (for example, four) of doors. The storage compartments (not shown), which are combined into one, may include a plurality of the partitions 170 and 180.

The storage compartment 111 according to another embodiment of the present disclosure may be coupled with one door (not shown) on one side thereof, unlike the case of FIG. 1 (for example, a plurality of doors).

The storage compartment (the first freezing compartment 112) according to another embodiment of the present disclosure may be implemented as a refrigerating compartment. For example, the storage compartment 111 may be a first refrigerating compartment and the storage compartment 112 may be a second refrigerating compartment.

FIGS. 4*a* to 4*d* are schematic perspective views and a schematic cross-sectional view of an intermediate partition duct of a refrigerator according to an embodiment of the present disclosure.

FIGS. Sato 5*d* are schematic perspective views and a schematic cross-sectional view of an intermediate partition of a refrigerator according to an embodiment of the present disclosure.

FIGS. 6*a* to 6*d* are schematic perspective views and a schematic cross-sectional view of an evaporator cover of a refrigerator according to an embodiment of the present disclosure.

Referring to FIGS. 3*a* and 3*b*, a cool air circulation unit 200 may be implemented with the intermediate partition duct 170, the intermediate partition 180, and the evaporator cover 185. The cool air circulation unit 200 may be implemented by a combination of the intermediate partition duct 170, the intermediate partition 180, and the evaporator cover 185.

In the cool air circulation unit 200, the intermediate partition duct 170, the intermediate partition 180 and the evaporator cover 185 may be mutually coupled through surface contact. The intermediate partition duct 170 and the evaporator cover 185 may be coupled together through a fit. The intermediate partition 180 and the evaporator cover 185 may be coupled together through a fit. In addition, the intermediate partition duct 170 and the intermediate partition 180 may be coupled together through a fit. The space between the intermediate partition duct 170 and the evaporator cover 185 may be sealed through a seal.

In another embodiment of the present disclosure, the intermediate partition duct 170, the intermediate partition 180, and the evaporator cover 185 of the cool air circulation unit 200 may be coupled together through an adhesive (or a fastening member (e.g., screws, rivets, etc.)).

The loss of cool air inside the storage compartments may be reduced through direct cool air supply by the cool air circulation unit 200 without additional components (for example, blow ducts or return ducts). Energy efficiency may be improved through the direct cool air supply by the cool air circulation unit 200 without additional components (for example, blow ducts or return ducts).

The assembly process may be reduced without additional components (for example, blow ducts or return ducts). In addition, the flowability (fluidity) of the insulating material foamed by the direct cool air supply through the cool air circulation unit 200 without additional components (for example, blow ducts or return ducts) may be improved.

Referring to FIGS. 4*a* to 4*d*, the intermediate partition duct 170 may be positioned on an upper portion of the cool air circulation unit 200. The intermediate partition duct 170 may discharge the cool air supplied from the evaporator 190 to the freezing compartment 112. The intermediate partition duct 170 may discharge the cool air supplied from the evaporator 190 to the freezing compartment 112 through a flow passage provided in the intermediate partition duct 170. The intermediate partition duct 170 may discharge the cool air supplied from the evaporator 190 to the freezing compartment 112 through a cool air flow passage (or cool air supply flow passage) provided in the intermediate partition duct 170 without a separate blow duct (or supply duct) connected through the surface of the intermediate partition duct 170 from the outside of the inner case 101*a*. In addition, the intermediate partition duct 170 may discharge the cool air supplied from the evaporator 190 to the freezing compartment 112 through a cool air flow passage (or cool air supply flow passage) provided in the intermediate partition duct 170 without a separate blow duct (or supply duct) contacting the insulator 110*c* between the inner case 101*a* and the outer case 101*b*. The intermediate partition duct 170 may be inserted from an outer rear of the inner case 110*a* of the refrigerator 100 (for example, between an outer surface of the inner case 110*a* and the outer case 110*b*). The outer surface of the intermediate partition duct 170 may be in contact with the foamed insulator 110*c*. Also, the outer surface of a partition neck 171*a* of the intermediate partition duct 170 may be in contact with the foamed insulator 110*c*.

The intermediate partition duct 170 may include a main body 171, the partition neck 171*a*, the inflow passage 172, a chamber 173, an outflow passage 174, and a chamber cover 175. The cross section of the intermediate partition duct 170 may be formed in the shape of '¬' The inflow passage 172 and the outflow passage 174 may be positioned between the inner case 110*a* and the outer case 110*b*. The inflow passage 172 and the outflow passage 174 may be positioned at the outside of the inner case 110*a*. In addition, a portion of the inflow passage 172 or a portion of the outflow passage 174 may be positioned at the outside of the inner case 110*a*.

In an embodiment of the present disclosure, the inflow passage 172 of the intermediate partition duct 170 may be referred to as a second inflow passage. Also, the inflow passage 185*b* of the evaporator cover 185 may be referred to as a first inflow passage.

The intermediate partition duct 170 may include the main body 171 coupled to the chamber cover 175 and the partition neck 171*a* extending from one end of the main body 171 at a predetermined angle (for example, between 70° and 95°) to be connected to an upper end of the evaporator cover 185. The gap between the partition neck 171*a* and the evaporator cover 185 may be sealed by a seal (not shown).

The inflow passage 172, which is a passage of cool air supplied through the evaporator cover 195, may be formed inside the partition neck 171*a*. One end (for example, an inlet 172*a* of the inflow passage) of the inflow passage 172 in the partition neck 171*a* may be connected to the evaporator cover 185. The inflow passage 172 in the freezing compartment 112 may be positioned closer to the outer case 110*b* than the outflow passage 174.

The sectional shape of the inflow passage 172 may be a polygon or may be a polygon whose edges are round. The sectional shape of the inflow passage 172 may also be circular or elliptical.

A thickness t1 of the inflow passage 172 may be smaller than an outer thickness t2 of the partition neck 171*a*. For example, the thickness t1 of the inflow passage 172 may be 29 mm. The thickness t1 of the inflow passage 172 may be greater than 27 mm and less than 35 mm. The thickness t1 of the inflow passage 172 may also be greater than 22 mm and less than 31 mm.

The outer thickness t2 of the partition neck 171*a* may be 51 mm. The outer thickness t2 of the partition neck 171*a* may be greater than 46 mm and less than 60 mm. The outer thickness t2 of the partition neck 171*a* may also be greater than 38 mm and less than 55 mm.

An inner thickness t3 of the partition neck 171*a* may be smaller than the thickness t1 of the inflow passage 172 and the outer thickness t2 of the partition neck 171*a*. The inner thickness t3 of the partition neck 171*a* may be 12 mm. The inner thickness t3 of the partition neck 171*a* may be greater than 10 mm and less than 20 mm. The inner thickness t3 of the partition neck 171*a* may also be greater than 7 mm and less than 15 mm.

One end (for example, an outlet 172*b* of the inflow passage) of the inflow passage 172 in the partition neck 171*a* may be connected to the chamber 173. One end (for example, the inlet 172*a* of the inflow passage) of the inflow passage 172 in the partition neck 171*a* may be connected to the evaporator cover 185.

The cool air that has been heat-exchanged through the evaporator 190 may be circulated (or forced circulated) by a fan 186. The cool air supplied to the chamber 173 by the fan 186 can be pressurized. Stress may be generated in the inflow passage 172 by the pressurized cool air. A maximum stress may be generated at the outlet 172*b* of the inflow passage 172 by the pressurized cool air.

A rib (not shown) is formed at the outlet 172*b* of the inflow passage 172 (for example, to divide the outlet 172*b* into two portions) to cope with the stress generated at the outlet 172*b* of the inflow passage 172. The thickness of the rib may be greater than 6 mm and less than 16 mm. The rib may be positioned in the chamber 173 connected to the outlet 172*b* of the inflow passage 172.

A jig 173*a* may be positioned adjacent to the outlet 172*b* of the inflow passage 172 to cope with the stress generated in the outlet 172*b* of the inflow passage 172. Also, the outside of the outlet 172*b* of the inflow passage 172 (for example, in −x-axis direction, between the main body 171 and the foamed insulator 110*c*) may be reinforced with an adhesive (or bonding) synthetic resin plate (for example, including ABS (Acrylonitrile Butadiene Styrene), not shown) to cope with the stress generated in the outlet 172*b* of the inflow passage 172. The thickness of the synthetic resin plate may be greater than 0.5 mm and less than 4 mm.

The cross-sectional area of the inflow passage 172 may be 4,200 $mm^2$. The cross-sectional area of the inflow passage 172 may also be greater than 3,300 $mm^2$ and less than 5,400 $mm^2$. The cross-sectional areas between the inlet 172*a* and the outlet 172*b* of the inflow passage 172 may be the same or different. In addition, a portion of the flow passage between the inlet 172*a* and the outlet 172*b* of the inflow passage 172 may be tapered.

In an embodiment of the present disclosure, the number (for example, '1') of the inlets 172*a* and the number (for example, '2' or more) of the outlets 172*b* of the inflow passage 172 may be different. In an embodiment of the present disclosure, a plurality of the inflow passages 172 (for example, '2' or more) may be provided. In a case where a plurality of the inflow passages 172 may be provided, a plurality of the inlets 172*a* that are connected to the evaporator cover 185 may be provided.

The chamber 173 of the intermediate partition duct 170 may be coupled to the chamber cover 175. The chamber 173 and the chamber cover 175 that are coupled to each other may store the cool air that is supplied through the inflow passage 172. The chamber 173 and the chamber cover 175 that are coupled each other may change the traveling direction (or flowing direction) of the cool air that is supplied through the inflow passage 172. The traveling direction of the cool air may be determined by the chamber 173, the chamber cover 175, and the outflow passage 174.

The traveling direction of the cool air (for example, supplied to the freezing compartment 112) may be opposite to the traveling direction of the cool air supplied to the chamber 173. The changed traveling direction of the cool air may form an obtuse angle with respect to the inlet 172*a* of the inflow passage 172, for example. The changed traveling direction of the cool air may also form an angle greater than 120° and less than 200° with respect to the inlet 172*a* of the inflow passage 172, for example.

The changed traveling direction of the cool air may be directed to the freezing compartment 112.

A partial flow passage (for example, a first outflow passage) of the outflow passage 174 may be implemented by the chamber cover 175 coupled to the chamber 173. The remaining flow passage (for example, a second outflow passage) of the outflow passage 174 may be implemented inside the intermediate partition duct 170. In an embodiment of the present disclosure, the outflow passage 174 may include the first outflow passage and the second outflow passage.

The outflow passage 174 may be bent once or more than once at a predetermined angle between an inlet 174*a* and an outlet 174*b*. The outflow passage 174 may be bent once or more than once at a predetermined angle between the inlet 174*a* and the outlet 174*b*.

The outlet 174*b* of the outflow passage 174 may be adjacent to the outlet 172*b* of the inflow passage 172 by the bent outflow passage 174. For example, the outlet 174*b* of the outflow passage 174 may be positioned farther from the outlet 172*b* of the inflow passage 172 as the bending of the outflow passage 174 is smaller (for example, as the predetermined angle is smaller as compared with FIG. 3*b*). An opening (not shown) corresponding to the outlet 174*b* of the outflow passage 174 may be formed on the inner case 110*a* of the main body 110 of the refrigerator 100.

In an embodiment of the present disclosure, the number (for example, '1') of the inlets 174*a* and the number (for example, '2' or more) of the outlets 174*b* of the outflow passage 174 may be different. In an embodiment of the present disclosure, a plurality of the outflow passages 174 (for example, '2' or more) may be provided. In a case where a plurality of the outflow passages 174 may be provided, a plurality of the outlets 174*b* of the outflow passages 174 that are connected to the freezing compartment 112 may be provided.

In a case where a plurality of the outlets 174*b* of the outflow passages 174 may be provided, the respective outlets 174*b* may be located at the same distance or at different distances with respect to the inflow passage 172. For example, one of the outlets 174*b* may be located close to the inflow passage 172, and the other outlet (not shown) may be located farther away from the inflow passage 172 than the one outlet 174*b*.

The cross-sectional area of the outflow passage 174 may be the same as or different from the cross-sectional area of the inflow passage 172. For example, the cross-sectional area of the inlet 174*a* of the outflow passage 174 may be the same as or different from the cross-sectional area of the outlet 172*b* of the inflow passage 172.

Figure 4A:
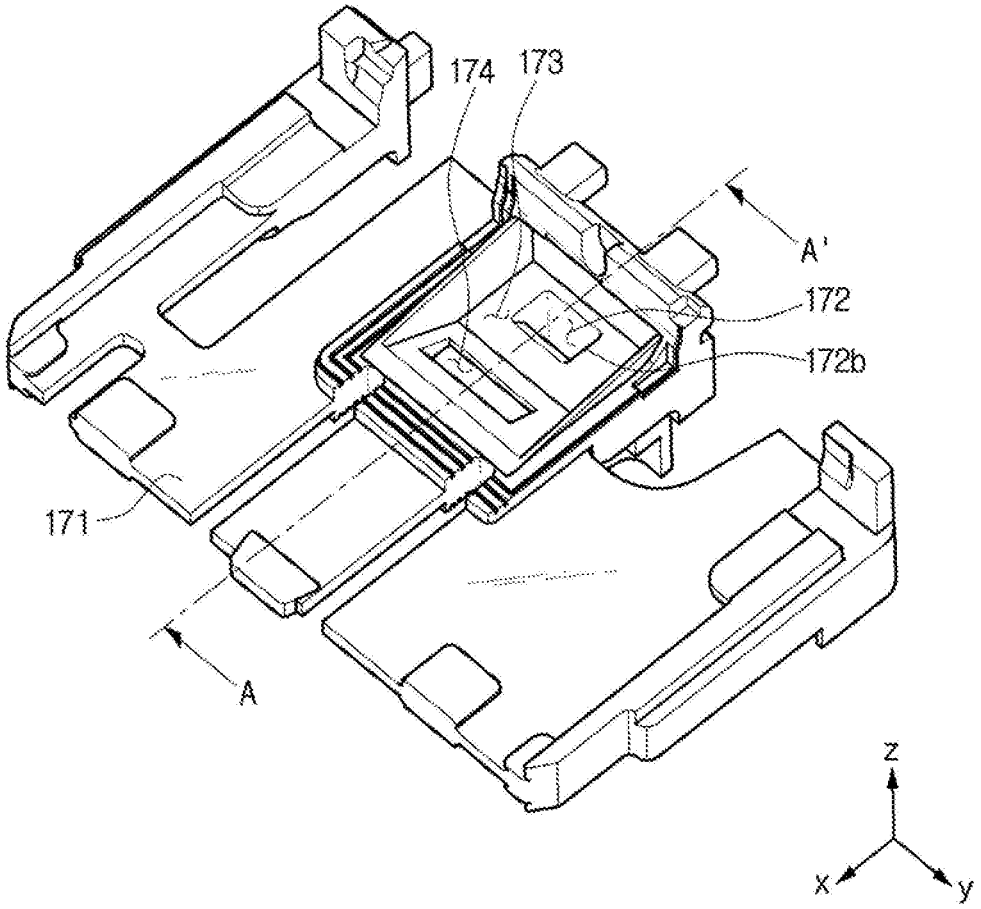
FIGS. 4*a* to 4*d* are schematic perspective views and a schematic cross-sectional view of an intermediate partition duct of a refrigerator according to an embodiment of the present disclosure.
Figure 4B:
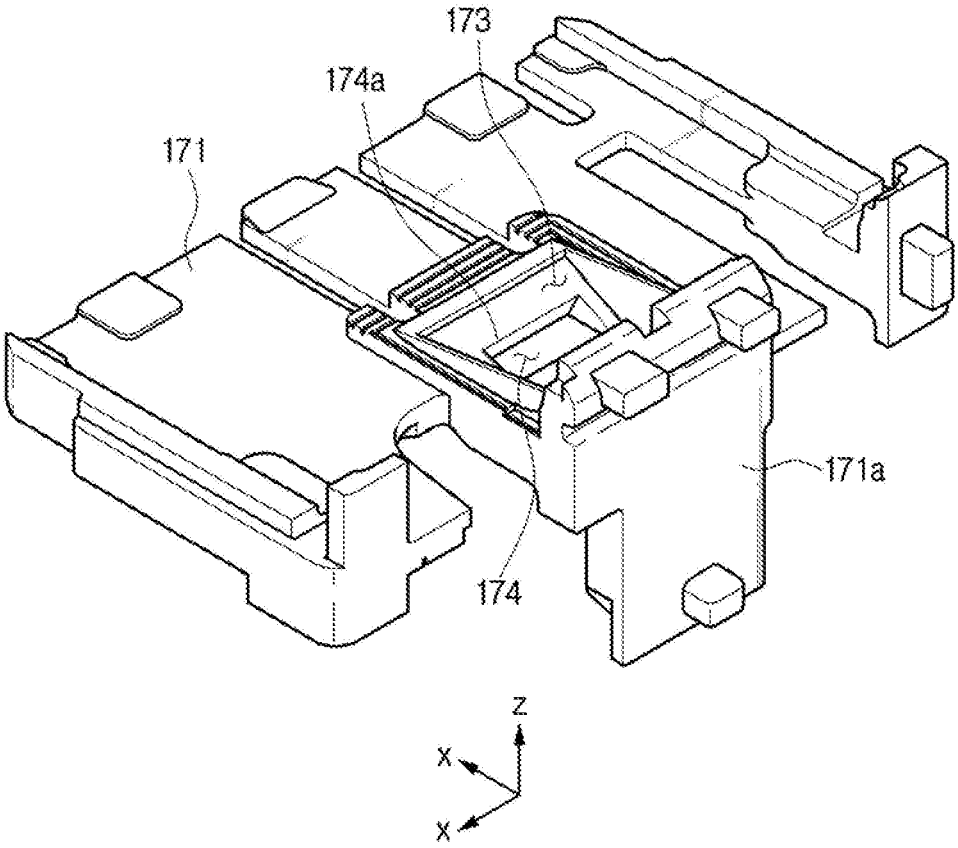
Figure 4C:
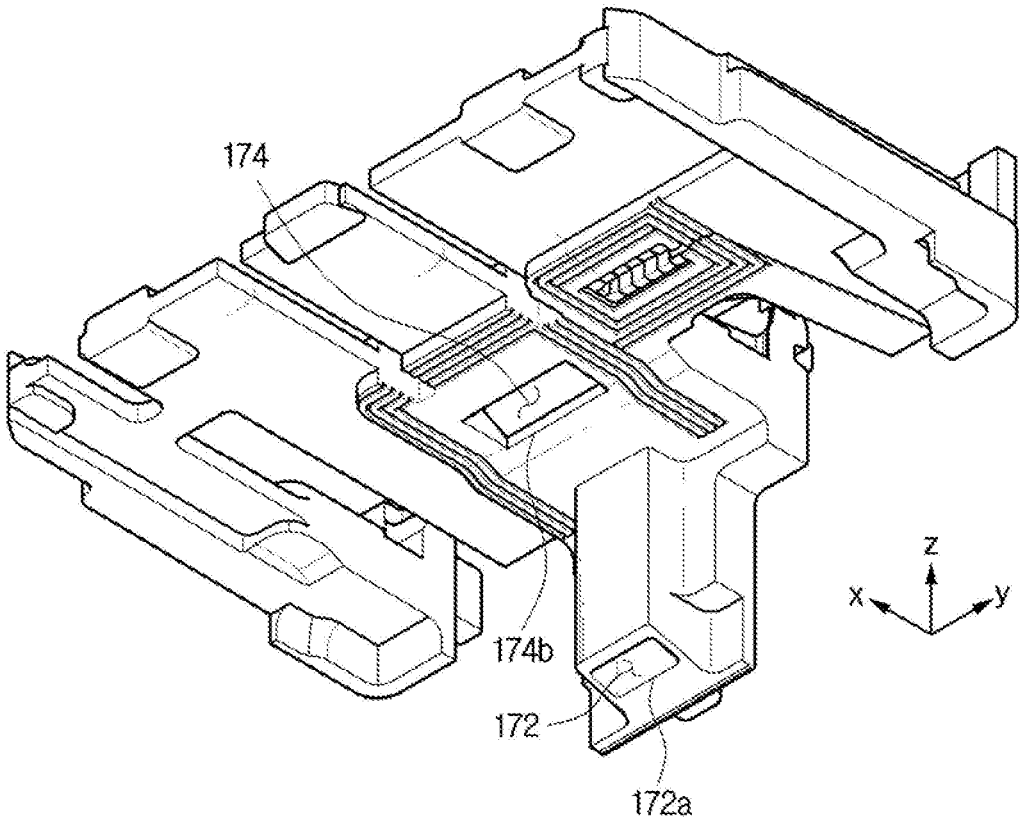
Figure 4D:
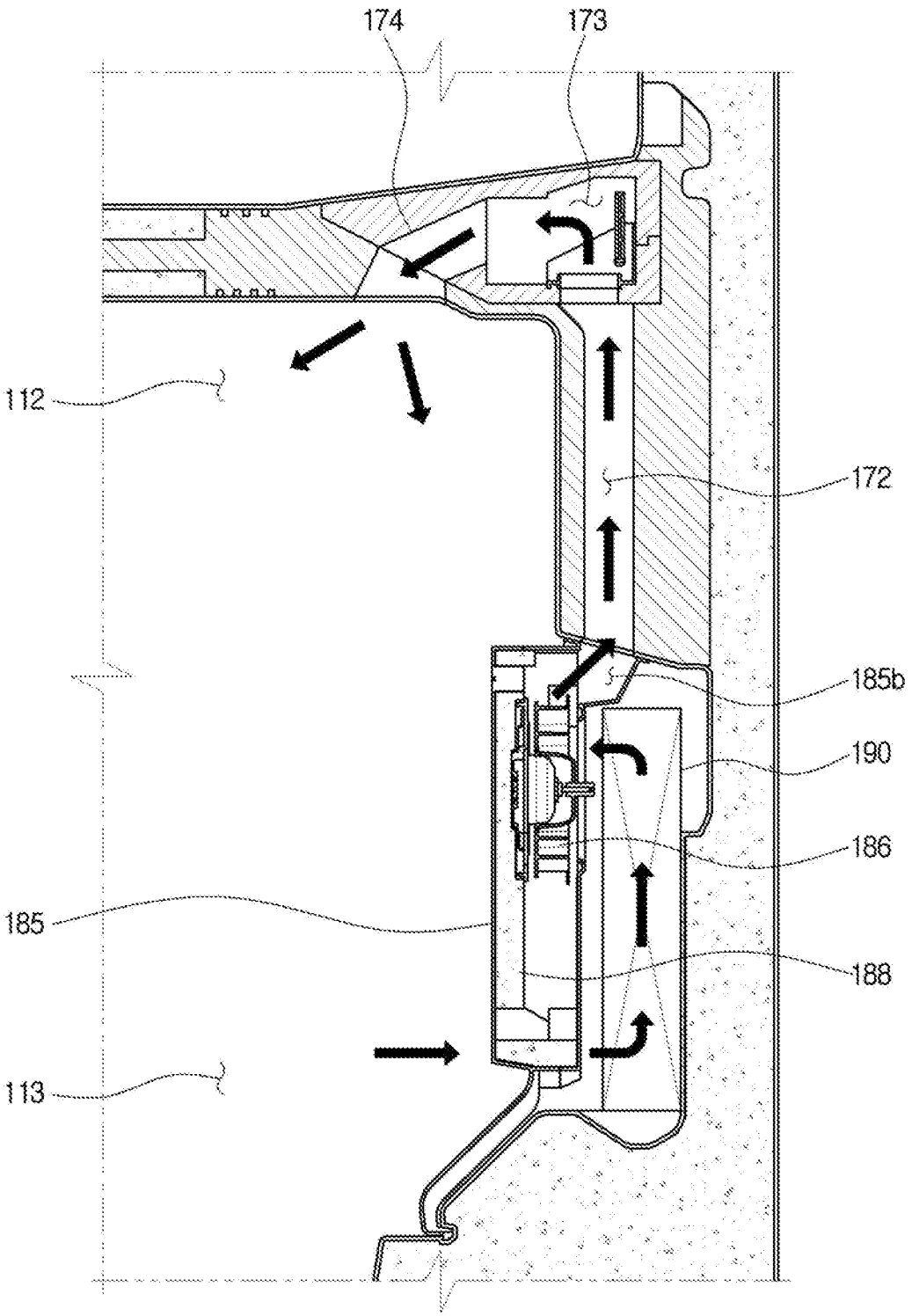

Referring to FIG. 4*d*, which is a cross-sectional view corresponding to line A-A' in FIG. 4*a*, the cool air that has been heat-exchanged in the evaporator 190 is pressurized (or blown) by the fan 186 in the evaporator cover 185 and passes through the inflow passage 185*b* of the evaporator cover 185, and then may enter the inlet 172*a* of the inflow passage 172. An opening (through which cool air passes, not shown) corresponding to an outlet 185*b*1 (refer to FIG. 6*a*) of the inflow passage 185*b* of the evaporator cover 185 and the inlet 172*a* of the inflow passage 172 of the intermediate partition duct 170 may be formed on the inner case 110*a*.

The cool air discharged from the outlet 172*b* of the inflow passage 172 may be received in the chamber 173. The cool air whose direction is changed by the chamber 173 and the chamber cover 175 may enter the inlet 174*a* of the outflow passage 174. The cool air whose direction is changed again by the bent outflow passage 174 may be discharged to the storage compartment 112 through the outlet 174*b* of the outflow passage 174.

The cool air in the storage compartment 112 or the cool air in the storage compartment 113 may be returned (circulated) to the evaporator 190.

The intermediate partition duct 170 may further include an insulator 176 as well as the inlet and outflow passages 172 and 174 therein. The volume of the insulator 176 filling a portion of the inside of the intermediate partition duct 170 may be larger than the volume of the inlet and outflow passages 172 and 174.

Referring to FIGS. 5*a* to 5*d*, the intermediate partition 180 may be positioned below the intermediate partition duct 170 in the cool circulation unit 200. The intermediate partition 180 may discharge the cool air in the freezing compartment 112, which has been supplied from the intermediate partition duct 170, toward the evaporator cover 185. A portion of the intermediate partition 180 (for example, the region including return flow passages 182 and 183) may be in contact (or combine) with the evaporator cover 185. A portion of the intermediate partition 180 (for example, the region including the return flow passages 182 and 183) may be in contact (or combine) with a portion of the evaporator cover 185 (for example, corresponding to the return flow passages 182 and 183 of the intermediate partition 180). In addition, a portion of the intermediate partition 180 (for example, the region including the return flow passages 182 and 183) may be located above a portion of the evaporator cover 185 (for example, corresponding to the return flow passages 182 and 183 of the intermediate partition 180).

The cool air in the freezing compartment 112 may be discharged toward the evaporator cover 185 through the return flow passages 182 and 183 of the intermediate partition 180. The cool air in the freezing compartment 112 may be discharged toward the evaporator cover 185 through inlets 182*a* and 183*a* of the return flow passages 182 and 183, and flow passages (or return flow passages 182*b* and 183*b*) of the intermediate partition 180. The cool air in the freezing compartment 112 may be discharged toward the evaporator cover 185 through the inlets 182*a* and 183*a* of the return flow passages 182 and 183 of the intermediate partition 180 and the flow passages (or the first return flow passages 182*b* and 183*b*) provided inside the intermediate partition 180. Also, the cool air in the freezing compartment 112 may be forcibly discharged by the rotation of the fan 186.

The intermediate partition 180 may be inserted from an inner front side of the inner case 110*a* (for example, where the first and second doors 120 and 130 are located). The surface of the intermediate partition 180 may be in contact with the inner case 110*a*. Also, the side surfaces of the intermediate partition 180 may be in contact with the side surfaces of the inner case 110*a*.

The intermediate partition 180 may include a main body 181, and the return flow passages 182 and 183. The intermediate partition 180 in the form of a plate may also include a concave portion (or concave region) 180*a* which is in surface contact with the inner case 110*a* corresponding to the partition neck 171*a* of the intermediate partition duct 170. The shape of the concave portion 180*a* may be implemented according to the shape of the partition neck 171*a* or the shape of the inner surface of the intermediate partition 180 corresponding to the outer surface of the inner case 110*a* which is in contact with the partition neck 171*a*.

The distance from the inlets 182*a* and 183*a* of the return flow passages 182 and 183 to the doors 120 and 130 may be longer than the distance from the inlets 182*a* and 183*a* of the return flow passages 182 and 183 to the partition neck 171*a* of the intermediate partition duct 170. The distances from the center of the concave portion 180*a* to the respective inlets 182*a* and 183*a* of the return flow passages 182 and 183 may be different. For example, the distance from the center of the concave portion 180*a* to the inlet 182*a* of the return flow passage 182 may be shorter than the distance from the center of the concave portion 180*a* to the inlet 183*a* of the return flow passage 183.

Figure 5A:
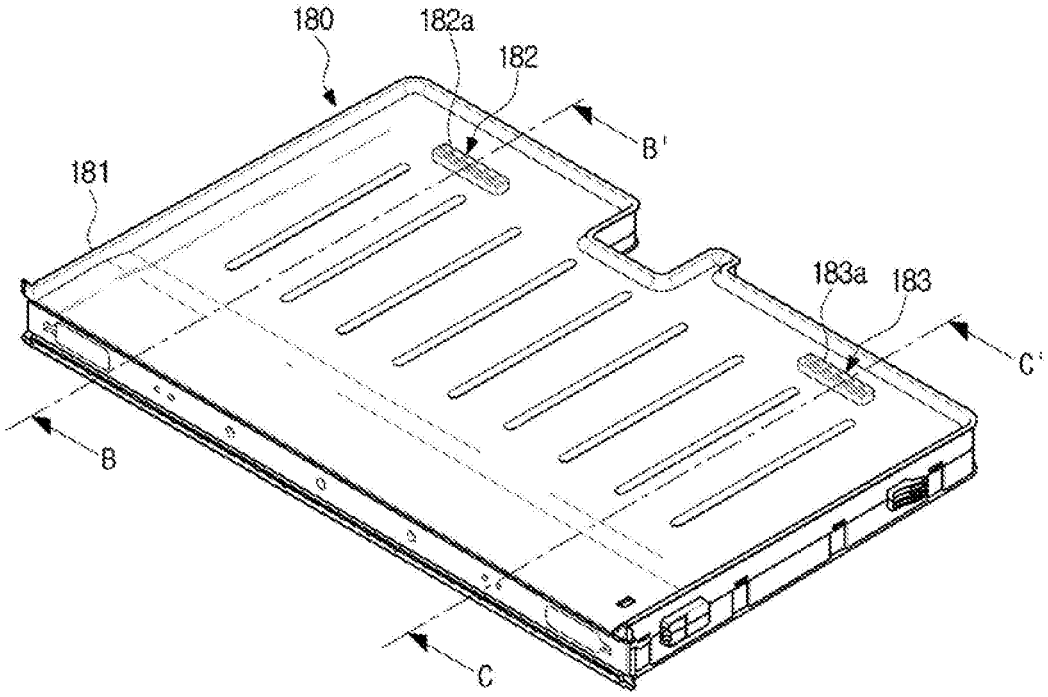
FIGS. 5*a* to 5*d* are schematic perspective views and a schematic cross-sectional view of an intermediate partition of a refrigerator according to an embodiment of the present disclosure.
Figure 5B:
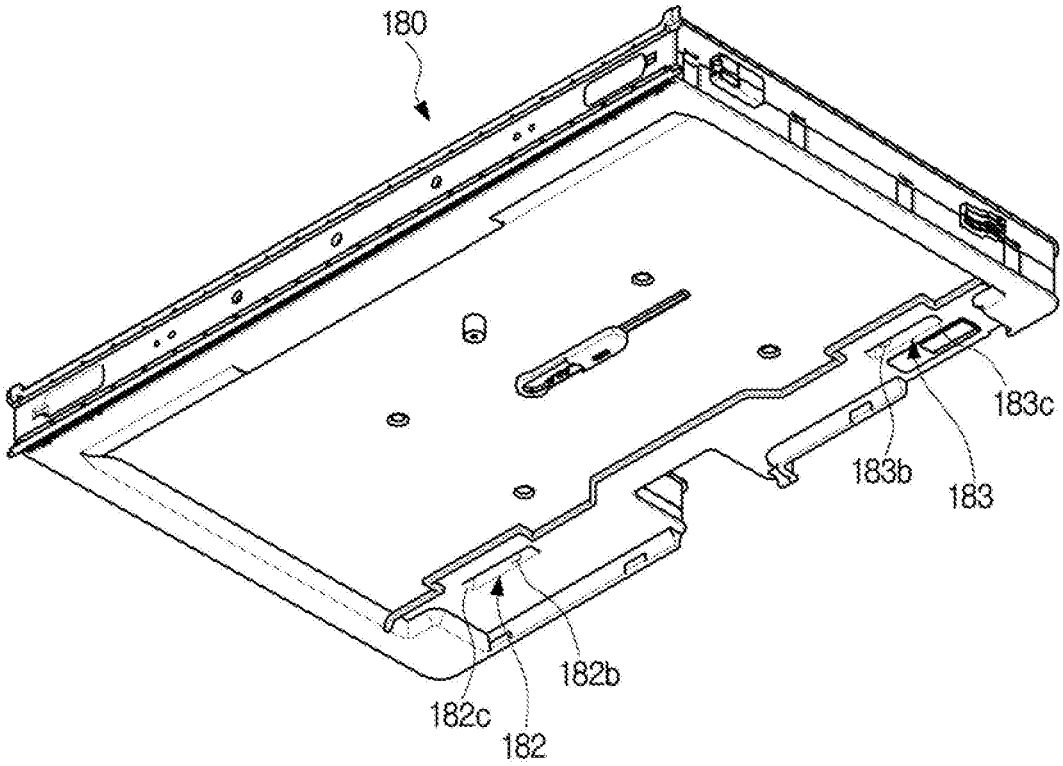
Figure 5C:
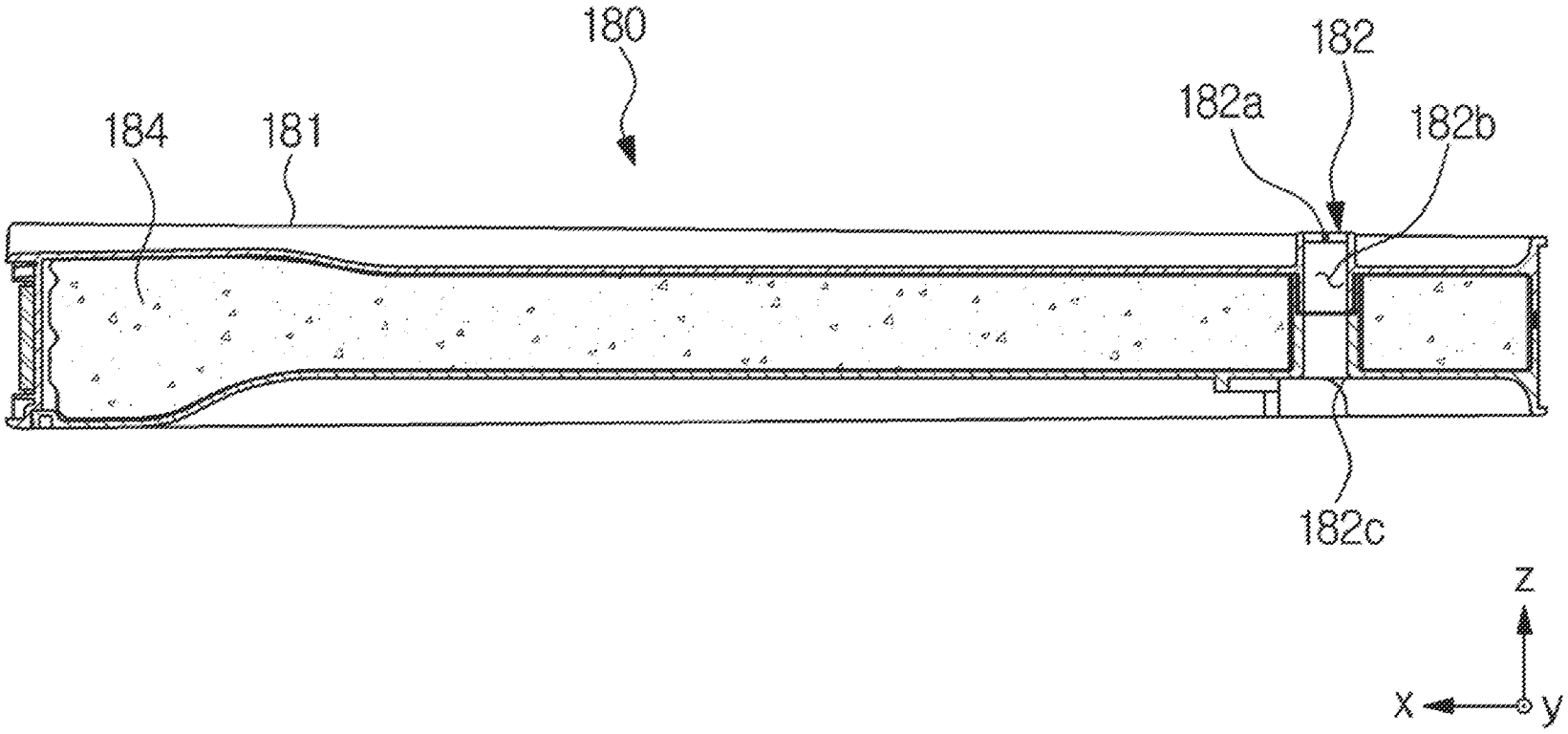
Figure 5D:
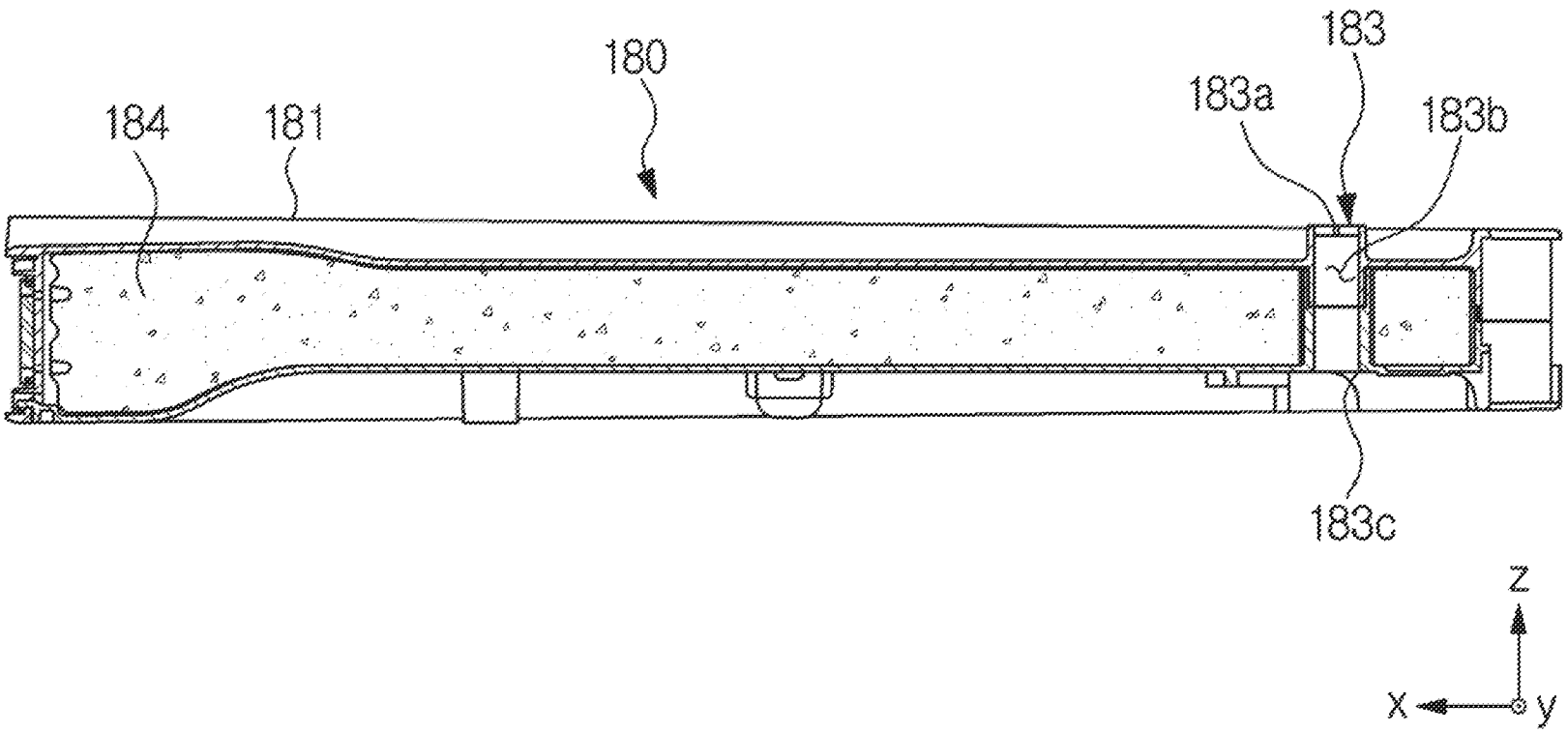

FIG. 5*c* is a cross-sectional view of the return flow passage 182 corresponding to line B-B' in FIG. 5*a*, and FIG. 5*d* is a cross-sectional view of the return flow passage 183 corresponding to line C-C' in FIG. 5*a*.

Referring to FIGS. 5*c* and 5*d*, the flow passages (or the first return flow passages 182*b* and 183*b*) extending from the inlets 182*a* and 183*a* of the return flow passages 182 and 183, which are discharge flow passages of cool air, may be provided in the main body 181.

The return flow passages 182 and 183 may include the inlets 182*a* and 183*a*, the return flow passages 182*b* and 183*b*, and outlets 182*c* and 183*c*. The above-described return flow passages provided in the intermediate partition 180 may be referred to as first return flow passages. Also, the return flow passage provided in the evaporator cover 185 may be referred to as a second return flow passage.

The shape of the inlet 182*a* of the return flow passage 182 may be the same as the shape of the inlet 183*a* of the return flow passage 183 (for example, an ellipse, a circle, a polygon, or a polygon whose edges are rounded). The cross-sectional area of the inlet 182*a* of the return flow passage 182 may be the same as the cross-sectional area of the inlet 183*a* of the return flow passage 183. For example, the cross-sectional area of the inlet 182*a* of the return flow passage 182 may be 1,300 $mm^2$. The cross-sectional area of the return flow passage 182 may be greater than 1,000 $mm^2$ and less than 1,600 $mm^2$.

The cross-sectional areas of the flow passage 182*b* between the inlet 182*a* and the outlet 182*c* of the return flow passage 182 may be the same or different. The cross-sectional areas of the flow passage 183*b* between the inlet 183*a* and the outlet 183*c* of the return flow passage 183 may be the same or different.

A portion of the flow passage 182*b* provided between the inlet 182*a* and the outlet 182*c* of the return flow passage 182 may be tapered. A portion of the flow passage 183*b* provided between the inlet 183*a* and the outlet 183*c* of the return flow passage 183 may be tapered.

The flow passage 182*b* between the inlet 182*a* and the outlet 182*c* of the return flow passage 182 may be inclined (for example, an obtuse angle in the backward direction (e.g., −x-axis direction) with respect to the surface of the main body 181). Also, the flow passage 183*b* between the inlet 183*a* and the outlet 183*c* of the return flow passage 183 may be inclined (for example, an obtuse angle in the backward direction (e.g., −x-axis direction) with respect to the surface of the main body 181). In a case where the flow passage 182*b* or 183*b* is inclined at an acute angle toward the front (e.g., x-axis direction) with respect to the surface of the main body 181, the flow passage 182*b* or 183*b* may be inclined toward the doors 120 and 130.

In an embodiment of the present disclosure, the number of the inlets of the return flow passage may be one, two, or three and more. In an embodiment of the present disclosure, the number of the inlets of the return flow passage may be different from the number of the outlets of the return flow passage. For example, the number of inlets of the return flow passage may be four (the flow passages extending from the inlet of the two return flow passages are joined), and the number of outlets of the return flow passage may be two.

The intermediate partition 180 may further include an insulator 184 therein. The volume of the insulator 184 filling a portion of the inside of the intermediate partition 180 may be larger than the volume of the return flow passages 182*b* and 183*b*.

The gap between the intermediate partition 180 and the evaporator cover 185 may be sealed through a seal.

Referring to FIGS. 6*a* to 6*d*, the evaporator cover 185 may be positioned below the intermediate partition 180 in the cool air circulation unit 200. The evaporator cover 185 may discharge the cool air in the freezing compartment 112, which has been discharged from the intermediate partition 180, toward the fan 186 through the return flow passages 187 and 188.

The cool air in the freezing compartment 112 may be discharged toward the fan 186 through the return flow passages 182 and 183 of the intermediate partition 180. The cool air in the freezing compartment 112 may be discharged toward the fan 186 through the return flow passages (or the first return flow passages 182 and 183) of the intermediate partition 180 and the return flow passages (or the second return flow passages 187 and 188) of the evaporator cover 185. The cool air in the freezing compartment 112 may be discharged toward the fan 186 through the return flow passages (or the first return flow passages 182 and 183) provided inside the intermediate partition 180 and the return flow passages (or the second return flow passages 187 and 188) provided inside the evaporator cover 185. Also, cool air in the freezing compartment 112 may be forcibly discharged by the rotation of the fan 186.

The evaporator cover 185 may be positioned in an inner rear of the inner case 110*a* of the refrigerator 100 (for example, adjacent to the evaporator 190). The surface of the evaporator cover 185 may be in contact with the inner case 110*a*. Further, the back surface of the evaporator cover 185 may be in contact with the surface of the inner case 110*a*.

The evaporator cover 185 may include a main body 185*a*, the inflow passage 185*b*, and the return flow passages 187 and 188. The evaporator cover 185 may include a space (not shown) that receives heat-exchanged cool air through the fan 186 and the evaporator 190.

The outlet 185*b*1 of the inflow passage (or the first inflow passage 185*b*) in the evaporator cover 185 may protrude obliquely from the back surface of the evaporator cover 185. The outlet 185*b*1 of the inflow passage (or the first inflow passage 185*b*) in the evaporator cover 185 may be positioned between the return flow passages 187 and 188. The outlet 185*b*1 of the inflow passage 185*b* may be connected to the inlet 172*a* of the inflow passage 172 of the intermediate partition duct 170.

The position of the inlets 187*a* and 188*a* of the return flow passages 187 and 188 may be closer to the evaporator 190 than the doors 120 and 130.

Figure 6A:
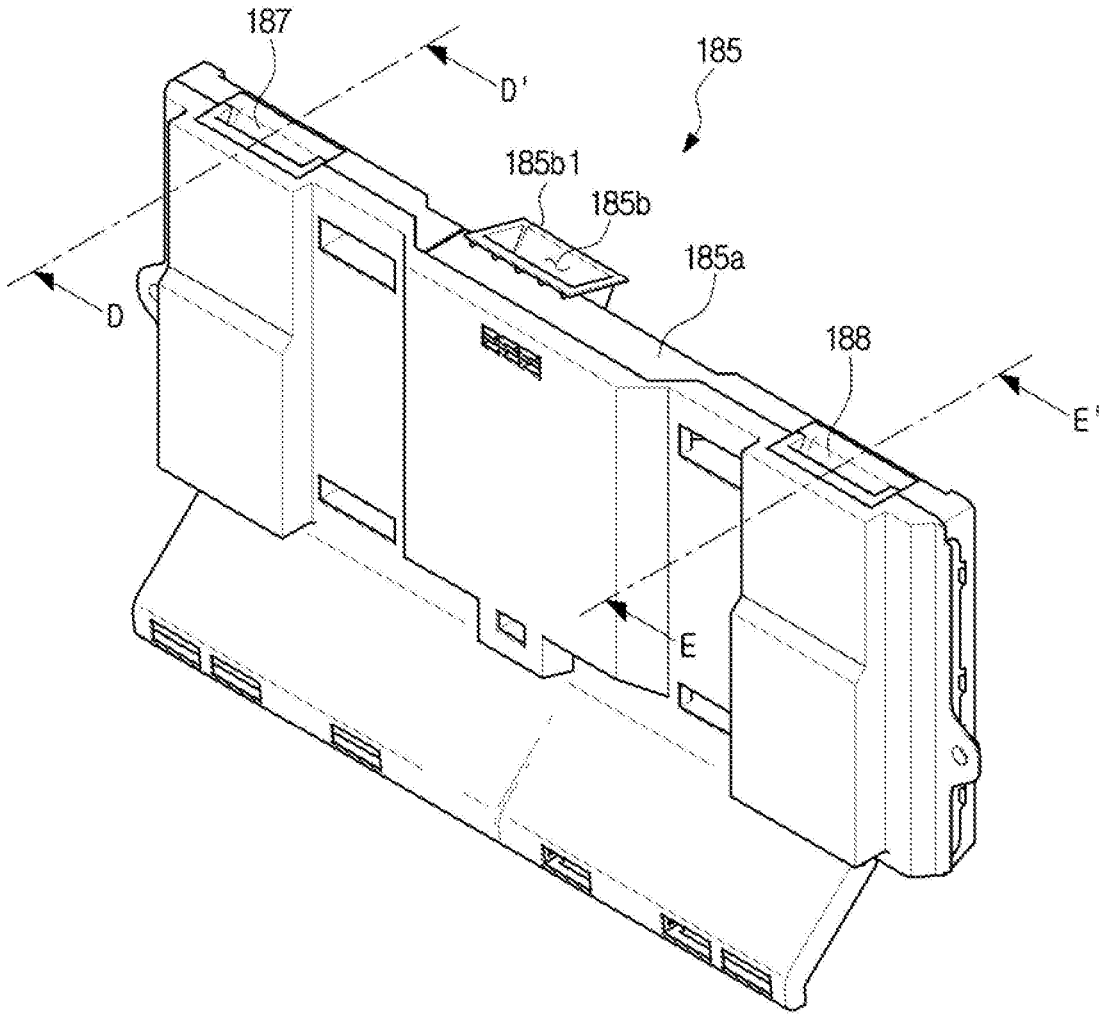
FIGS. 6*a* to 6*d* are schematic perspective views and a schematic cross-sectional view of an evaporator cover of a refrigerator according to an embodiment of the present disclosure.
Figure 6B:
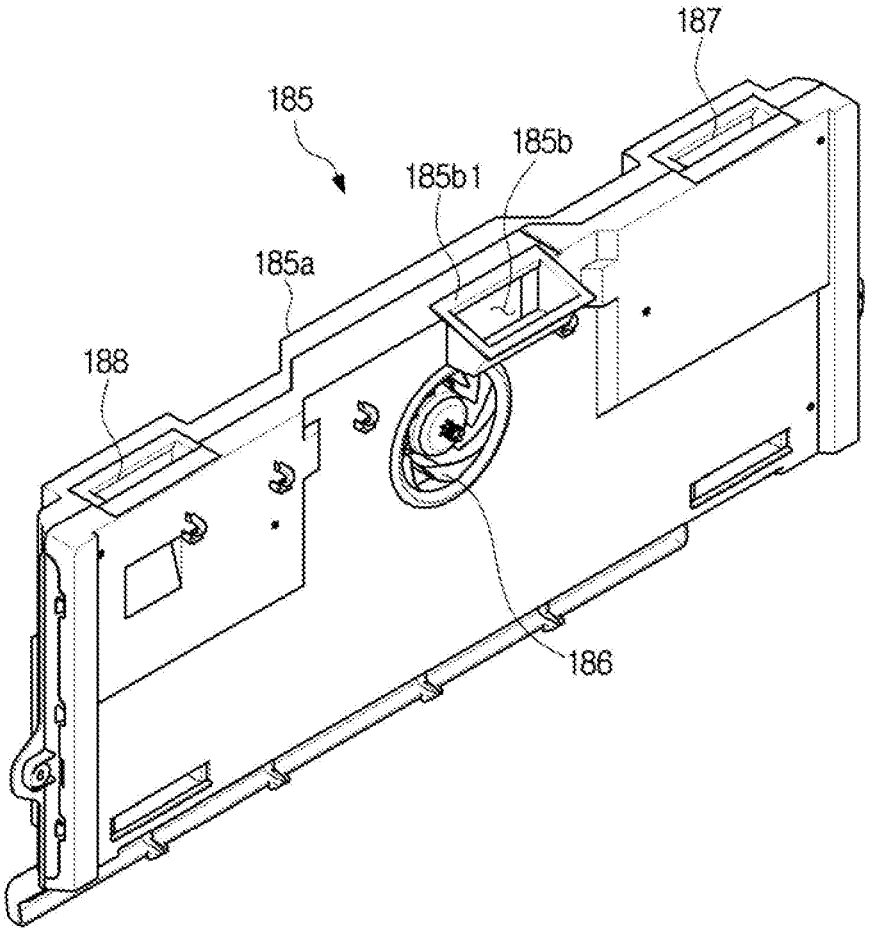
Figure 6C:
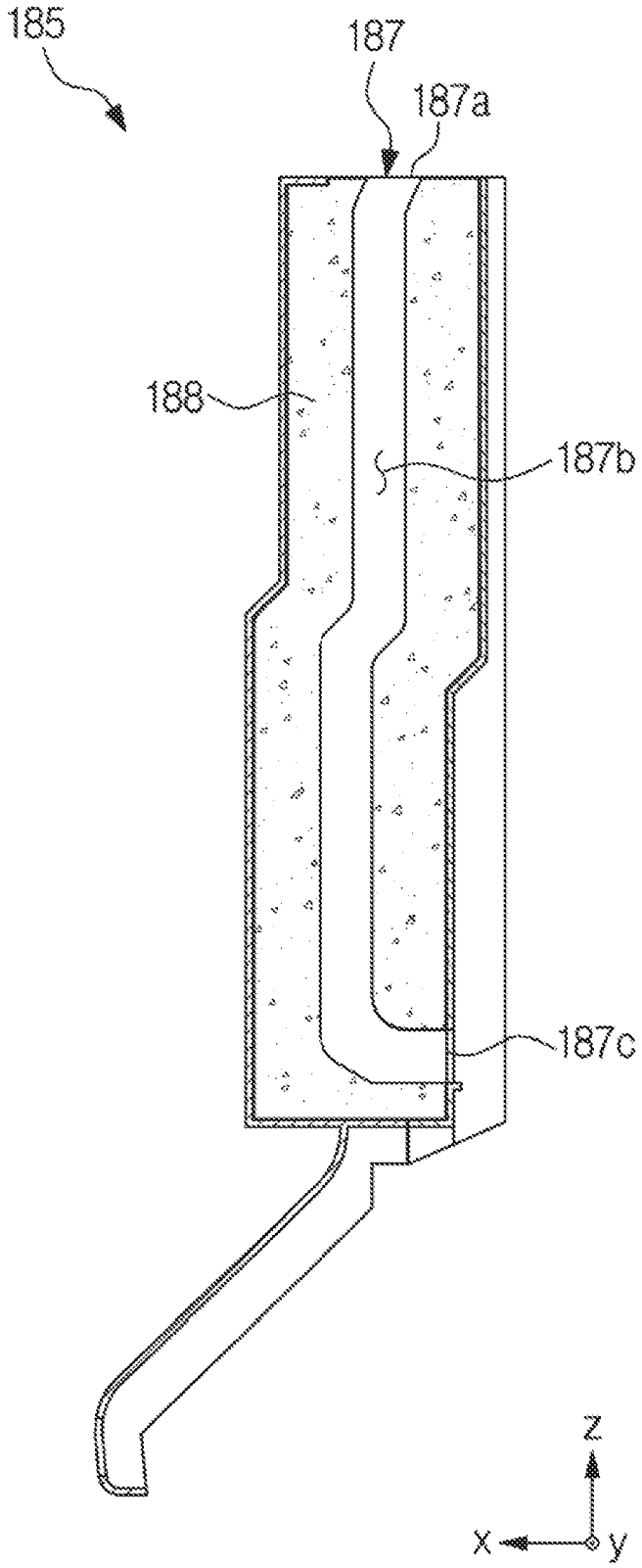
Figure 6D:
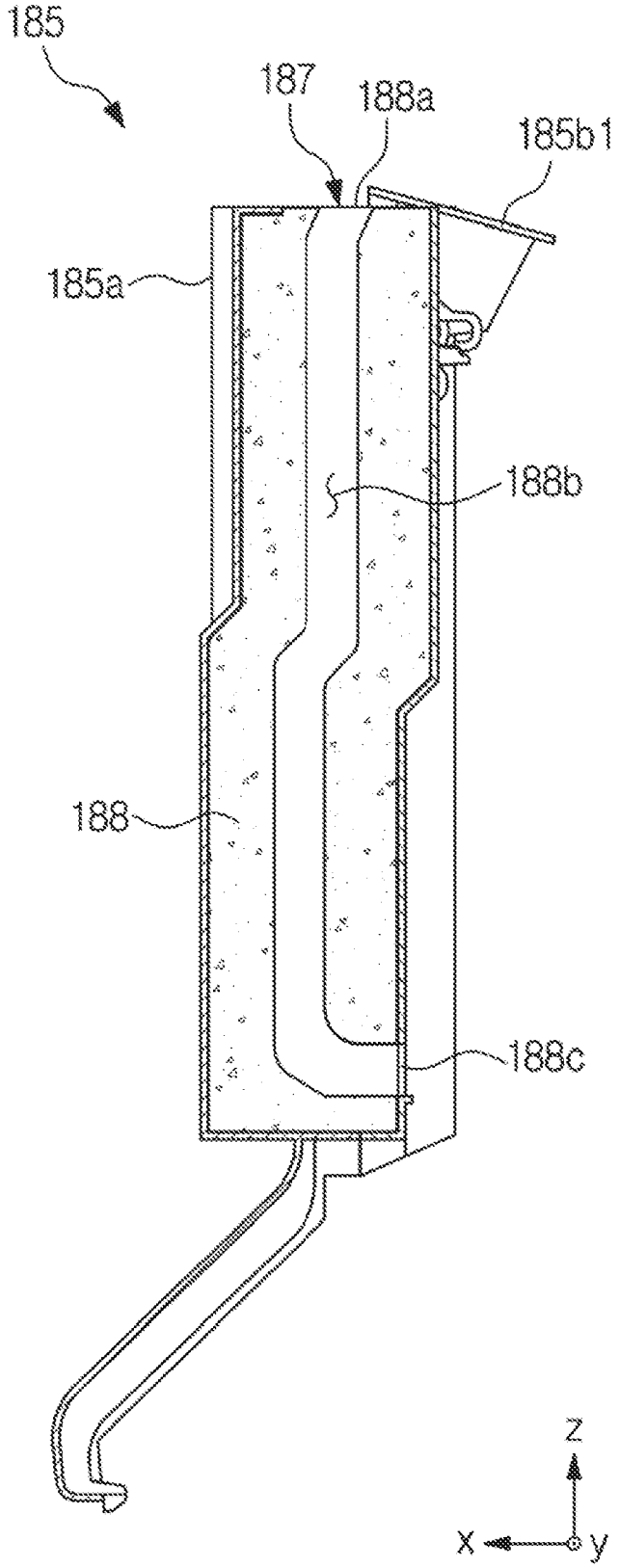

FIG. 6*c* is a cross-sectional view of the return flow passage 187 corresponding to line D-D' in FIG. 6*a*, and FIG. 6*d* is a cross-sectional view of the return flow passage 188 corresponding to line E-E' in FIG. 6*a*.

Referring to FIGS. 6*c* and 6*d*, return flow passages (or the second return flow passages) extending from the inlets 187*a* and 188*a* of the return flow passages 187 and 188, which are discharge flow passages of cool air, may be provided inside the opposite side surface of the main body 181. The return flow passages 187 and 188 may include the inlets 187*a* and 188*a*, flow passages 187*b* and 188*b*, and outlets 187*c* and 188*c*.

The inlets 187*a* and 188*a* of the return flow passages 187 and 188 may be positioned at an upper end of the outlets 187*c* and 188*c* in the main body 185*a*.

The shape of the inlet 187*a* of the return flow passage 187 may be the same as the shape of the inlet 188*a* of the return flow passage 188 (for example, an ellipse, a circle, a polygon, or a polygon whose edges are rounded). The cross-sectional area of the inlet 187*a* of the return flow passage 187 may be the same as the cross-sectional area of the inlet 188*a* of the return flow passage 188.

The cross-sectional areas of the flow passage 187*b* between the inlet 187*a* and the outlet 187*c* of the return flow passage 187 may be the same or different. The cross-sectional areas of the flow passage 188*b* between the inlet 188*a* and the outlet 188*c* of the return flow passage 188 may be the same or different.

A portion of the flow passage 187*b* between the inlet 187*a* and the outlet 187*c* of the return flow passage 187 may be tapered. The flow passage 187*b* between the inlet 187*a* and the outlet 187*c* of the return flow passage 187 may be inclined at a predetermined angle. For example, the flow passage 187*b* may be sequentially bent 45° forward (for example, in the door direction), 45° forward, and 90° backward.

A portion of the flow passage 188*b* between the inlet 188*a* and the outlet 188*c* of the return flow passage 188 may be tapered. The flow passage 188*b* between the inlet 188*a* and the outlet 188*c* of the return flow passage 188 may be inclined at a predetermined angle. For example, the flow passage 188*b* may be sequentially bent 45° forward (for example, in the door direction), 45° forward, and 90° backward. The predetermined angle is only an example and may be changed according to the length and structure of the flow passages 187*b* and 188*b*.

In an embodiment of the present disclosure, the number of the inlets 187*a* and 188*a* of the return flow passages 187 and 188 in the evaporator cover 185 may correspond to the number of the outlets 182*c* and 183*c* of the return flow passages 182 and 183 in the intermediate partition 180. The number of the return flow passages 187 and 188 in the evaporator cover 185 may be larger than the number of the inflow passages 185*b* in the evaporator cover 185.

The evaporator cover 185 may further include an insulator 188 therein. The volume of the insulator 188 filling a portion of the inside of the evaporator cover 185 may be larger than the volume of the flow passages 187*b* and 188*b*.

The foregoing detailed description is intended to illustrate and explain the preferred embodiments of the present disclosure, and the present disclosure may be used in various other combinations, modifications, and environments. That is, it is possible to make changes or modifications within the scope of the concept of the above-described disclosure, within an equivalent scope to the above-described disclosure, and/or within the skill or knowledge of the art.

Therefore, the detailed description of the present disclosure is not intended to limit the present disclosure to the disclosed embodiments. It is also to be understood that the appended claims are construed to cover further embodiments.

The invention claimed is:

1. A refrigerator comprising:

an evaporator;

a main body including an inner case, an outer case, and an insulator foamed between the inner case and the outer case; and a cool air circulation unit having an inner flow passage to supply cool air heat-exchanged in the evaporator to a storage compartment inside the inner case and discharge air from the storage compartment to the evaporator, wherein the inner flow passage in the cool air circulation unit is positioned inside and outside the inner case, wherein the cool air circulation unit includes an intermediate partition duct which divides the storage compartment and an evaporator cover which receives the evaporator, and the intermediate partition duct and the evaporator cover are coupled to each other.

2. The refrigerator according to claim 1, wherein:

the cool air circulation unit further includes an intermediate partition positioned below the intermediate partition duct and inside the inner case, and the evaporator cover is connected to the intermediate partition below the intermediate partition and positioned inside the inner case.

3. The refrigerator according to claim 2, wherein:

the intermediate partition duct includes an inflow passage to receive the cool air from the evaporator cover, a chamber connected to the inflow passage and receiving the cool air, and an outflow passage connected to the chamber and supplying the cool air to the storage compartment.

4. The refrigerator according to claim 3, wherein:

the intermediate partition duct further includes a chamber cover to cover the chamber, and the chamber changes the traveling direction of the cool air, which has been supplied from the inflow passage, to the outflow passage.

5. The refrigerator according to claim 4, wherein:

a traveling direction of the cool air is changed by at least one of the chamber, the chamber cover, and the outflow passage.

6. The refrigerator according to claim 3, wherein:

a cross-sectional area of an outlet of the inflow passage connected to the chamber is different from the cross-sectional area of an inlet of the outflow passage.

7. The refrigerator according to claim 2, wherein:

the cool air starts to flow from the inner case along the inner flow passage of the cool air circulation unit, flows outside the inner case, and is finally supplied to the storage chamber of the inner case.

8. The refrigerator according to claim 3, wherein:

the inflow passage and the outflow passage provided inside the intermediate partition duct are positioned outside the inner case.

9. The refrigerator according to claim 2, wherein:

a return flow passage to discharge the cool air in the storage compartment is provided inside the intermediate partition.

10. The refrigerator according to claim 9, wherein:

an inlet of the return flow passage is positioned on a surface of the intermediate partition facing the intermediate partition duct.

11. The refrigerator according to claim 9, wherein:

the cross-sectional area of the inlet of the return flow passage is different from the cross-sectional area of an outlet of the outflow passage of the intermediate partition duct.

12. The refrigerator according to claim 9, wherein:

a portion of the intermediate partition is in contact with an inner surface corresponding to an outer surface of the inner case in contact with the intermediate partition duct.

13. The refrigerator according to claim 2, wherein:

the evaporator cover includes a second return flow passage therein to discharge the cool air discharged from a first return flow passage of the intermediate partition to the evaporator.

14. The refrigerator according to claim 13, wherein:

the evaporator cover further includes a fan, and the cool air circulates through the inner flow passage of the cool air circulation unit by the fan.

15. The refrigerator according to claim 13, wherein:

a number of the second return flow passages is larger than a number of inflow passages of the evaporator cover.

* * * * *